US010289027B2

(12) United States Patent
Sako et al.

(10) Patent No.: US 10,289,027 B2
(45) Date of Patent: May 14, 2019

(54) IMAGE FORMING APPARATUS AND DEVELOPING DEVICE THAT CONVEYS AIR TO EXHAUST PORT

(71) Applicant: FUJI XEROX CO.,LTD., Tokyo (JP)

(72) Inventors: Kiyoshi Sako, Kanagawa (JP); Masaki Suto, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 15/805,146

(22) Filed: Nov. 7, 2017

(65) Prior Publication Data

US 2018/0253030 A1 Sep. 6, 2018

(30) Foreign Application Priority Data

Mar. 3, 2017 (JP) ..... 2017-040389

(51) Int. Cl.

| | |
|---|---|
| ***G03G 15/08*** | (2006.01) |
| ***G03G 15/09*** | (2006.01) |
| ***G03G 21/00*** | (2006.01) |
| ***G03G 21/20*** | (2006.01) |

(52) U.S. Cl.

CPC ..... *G03G 15/0872* (2013.01); *G03G 15/0891* (2013.01); *G03G 15/0808* (2013.01); *G03G 15/0886* (2013.01); *G03G 15/0887* (2013.01); *G03G 15/0893* (2013.01); *G03G 15/0896* (2013.01); *G03G 15/0898* (2013.01); *G03G 15/0942* (2013.01); *G03G 21/0047* (2013.01); *G03G 21/0052* (2013.01); *G03G 21/206* (2013.01)

(58) Field of Classification Search

CPC ..... G03G 15/0808; G03G 15/0836; G03G 15/0872; G03G 15/0886; G03G 15/0887; G03G 15/0889; G03G 15/0891; G03G 15/0896; G03G 15/0898; G03G 15/0942; G03G 21/0047; G03G 21/0052; G03G 21/206

See application file for complete search history.

(56) References Cited

U.S. PATENT DOCUMENTS

| | | | | |
|---|---|---|---|---|
| 5,111,247 A * | 5/1992 | Nichols | G03G 15/0849 | 366/142 |
| 2010/0215401 A1* | 8/2010 | Fujiwara | G03G 15/09 | 399/119 |
| 2013/0136502 A1* | 5/2013 | Shimizu | G03G 15/0836 | 399/258 |

(Continued)

FOREIGN PATENT DOCUMENTS

| | | |
|---|---|---|
| JP | 108220882 | 8/1996 |
| JP | 2009115970 | 5/2009 |
| JP | 2013080034 | 5/2013 |

*Primary Examiner* — Joseph S Wong
(74) *Attorney, Agent, or Firm* — JCIPRNET

(57) ABSTRACT

A developing device includes a developer carrier that rotates while holding a developer, a developer container that supports the developer carrier and contains the developer, a transport member that is supported in the developer container and that transports the developer by rotating, and a conveying member that is disposed on the transport member and that conveys air in the developer container toward an exhaust port, which enables the air in the developer container to be exhausted outside, along with rotation of the transport member.

14 Claims, 9 Drawing Sheets

(56) References Cited

U.S. PATENT DOCUMENTS

| | | | | |
|---|---|---|---|---|
| 2015/0227078 | A1* | 8/2015 | Kubo | G03G 15/0865 399/272 |
| 2015/0338777 | A1* | 11/2015 | Matsumoto | G03G 15/0893 399/254 |
| 2016/0026119 | A1* | 1/2016 | Ohashi | G03G 21/12 399/358 |

* cited by examiner

IMAGE FORMING APPARATUS AND DEVELOPING DEVICE THAT CONVEYS AIR TO EXHAUST PORT

CROSS-REFERENCE TO RELATED APPLICATIONS

This application is based on and claims priority under 35 USC 119 from Japanese Patent Application No. 2017-040389 filed Mar. 3, 2017.

BACKGROUND

Technical Field

The present invention relates to a developing device and an image forming apparatus.

SUMMARY

According to an aspect of the invention, there is provided a developing device including a developer carrier that rotates while holding a developer, a developer container that supports the developer carrier and contains the developer, a transport member that is supported in the developer container and that transports the developer by rotating, and a conveying member that is disposed on the transport member and that conveys air in the developer container toward an exhaust port, which enables the air in the developer container to be exhausted outside, along with rotation of the transport member.

BRIEF DESCRIPTION OF THE DRAWINGS

Exemplary embodiments of the present invention will be described in detail based on the following figures, wherein.

DETAILED DESCRIPTION

Figure 1:
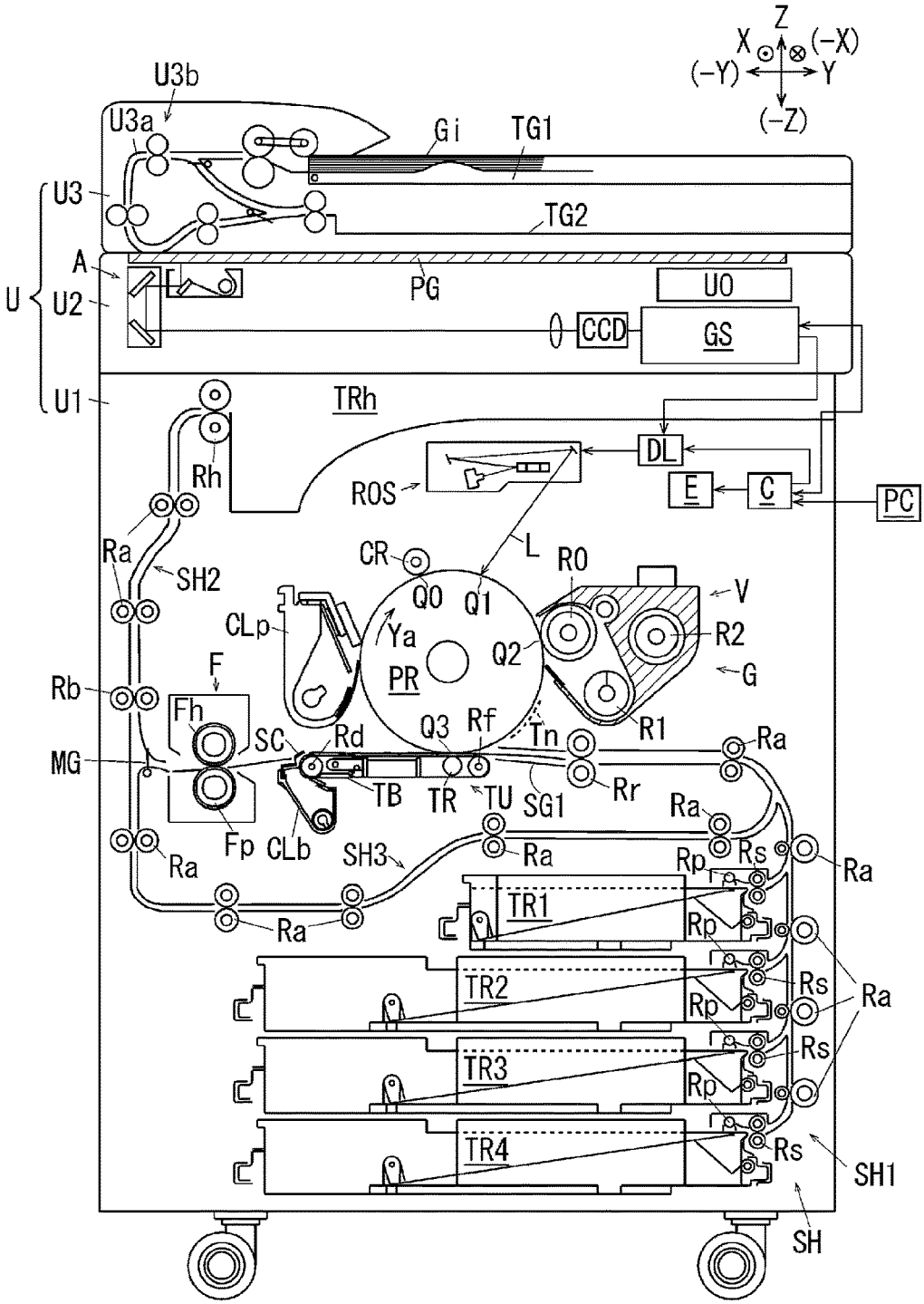
FIG. 1 is a diagram illustrating an image forming apparatus according to an exemplary embodiment of the present invention.

Although specific examples of exemplary embodiments of the present invention (hereinafter referred to as exemplary embodiments) will be described below with reference to the drawings, the present invention is not limited to the following exemplary embodiments. For ease of understanding of the following description, in the drawings, a front-rear direction, a left-right direction, and a top-bottom direction are respectively defined as the X-axis direction, the Y-axis direction, and the Z-axis direction, and directions or sides indicated by arrows X, −X, Y, −Y, Z, and −Z are respectively defined as a forward direction, a backward direction, a right direction, a left direction, an upward direction, and a downward direction or the front side, the rear side, the right side, the left side, the top side, and the bottom side. An arrow extending from the rear side to the front side in the drawings is denoted by an encircled dot, and an arrow extending from the front side to the rear side in the drawings is denoted by an encircled cross. In the following description, which refers to the drawings, descriptions and illustration of components that are not necessarily illustrated are suitably omitted for ease of understanding.

[Exemplary Embodiment ]

FIG. 1 is a diagram illustrating an image forming apparatus according to an exemplary embodiment of the present invention. In FIG. 1, a copying machine U, which is as an example of the image forming apparatus according to the present exemplary embodiment, includes a printer unit U1, which is an example of a recording unit and an example of an image recording device. A scanner unit U2, which is an example of a reading unit and an example of an image reading device, is supported on top of the printer unit U1. An autofeeder U3, which is an example of a document transport device, is supported on top of the scanner unit U2. A user interface U0, which is an example of an input unit, is supported in the scanner unit U2 of the present exemplary embodiment. An operator may operate the copying machine U by performing an input operation by using the user interface U0.

A document tray TG1, which is an example of a medium container, is disposed on the autofeeder U3. Plural documents Gi that are to be subjected to a copying operation may be stacked and accommodated in the document tray TG1. A document ejection tray TG2, which is an example of a document ejection unit, is formed below the document tray TG1. Document transport rollers U3*b* are disposed along a document transport path U3*a* between the document tray TG1 and the document ejection tray TG2.

A platen glass PG, which is an example of a transparent document table, is disposed on a top surface of the scanner unit U2. In the scanner unit U2 according to the present exemplary embodiment, a reading optical system A is disposed below the platen glass PG. The reading optical system A according to the present exemplary embodiment is supported in such a manner as to be movable in the left-right direction along a bottom surface of the platen glass PG. Note that the reading optical system A is normally stationary at an initial position illustrated in FIG. 1. An imaging device CCD, which is an example of an imaging member, is disposed on the right side of the reading optical system A. An image processing unit GS is electrically connected to the imaging device CCD. The image processing unit GS is electrically connected to a write circuit DL of the printer unit U1. The write circuit DL is electrically connected to an exposure device ROS, which is an example of a latent-image forming device.

A photoconductor drum PR, which is an example of an image carrier, is disposed in the printer unit U1. A charging roller CR, which is an example of a charging member, a developing device G, a transfer unit TU, which is an example of a transfer device, and a drum cleaner CLp, which is an example of a cleaning unit, are disposed around the photoconductor drum PR.

Sheet-feeding trays TR1 to TR4, each of which is an example of a medium container, are disposed below the transfer unit TU. A transport path SH1 extends from the sheet-feeding trays TR1 to TR4. Pick-up rollers Rp, each of which is an example of a medium pick-up member, separation rollers Rs, each of which is an example of a separation member, transport rollers Ra, each of which is an example of a transport member, and a pair of registration rollers Rr, each of which is an example of a delivery member, are disposed on the transport path SH1.

A fixing device F that includes a heating roller Fh and a pressure roller Fp is disposed on the left side of the transfer unit TU. The fixing device F and a sheet ejection tray TRh are connected to each other by an ejection path SH2. The ejection path SH2 and the pair of registration rollers Rr are connected to each other by a reverse path SH3. A pair of transport rollers Rb that are capable of rotating in both forward and reverse directions and a pair of ejection rollers Rh are disposed on the ejection path SH2.

(Description of Image Forming Operation)

The plural documents Gi accommodated in the document tray TG1 sequentially pass through a document reading position on the platen glass PG and are ejected to the document ejection tray TG2. In the case of performing a copying operation by automatically transporting the documents Gi by using the autofeeder U3, the reading optical system A exposes the documents Gi, which sequentially pass through the reading position on the platen glass PG, to light while being stationary at the initial position. In the case where an operator performs a copying operation by placing one of the documents Gi on the platen glass PG by using their hands, the reading optical system A moves in the left-right direction in such a manner that the document Gi on the platen glass PG is scanned while being exposed to the light. Light beams that have been reflected by the document Gi are converged to the imaging device CCD through the reading optical system A. The imaging device CCD converts the light beams, which have been reflected by the documents Gi and converged to an imaging surface, into electrical signals.

The image processing unit GS converts signals, which are input from the imaging device CCD and read by the image processing unit GS, into digital image signals and outputs the digital image signals to the write circuit DL of the printer unit U1. The write circuit DL outputs control signals that correspond to image writing signals, which have been input to the write circuit DL, to the exposure device ROS. The exposure device ROS outputs a laser beam L in such a manner as to form a latent image on a surface of the photoconductor drum PR, the surface having been charged by the charging roller CR. The latent image on the surface of the photoconductor drum PR is developed into a visible image by the developing device G. A transfer roller TR of the transfer unit TU transfers the visible image on the surface of the photoconductor drum PR onto a recording sheet S that is an example of a medium and that has been transported along the transport path SH1. The visible image transferred to the recording sheet S is fixed in place by the fixing device F. When performing two-sided printing, the recording sheet S that has passed through the fixing device F is transported to the reverse path SH3, and when ejecting the recording sheet S to the sheet ejection tray TRh, the recording sheet S is ejected by the ejection rollers Rh.

(Description of Developing Device)

Figure 2A:
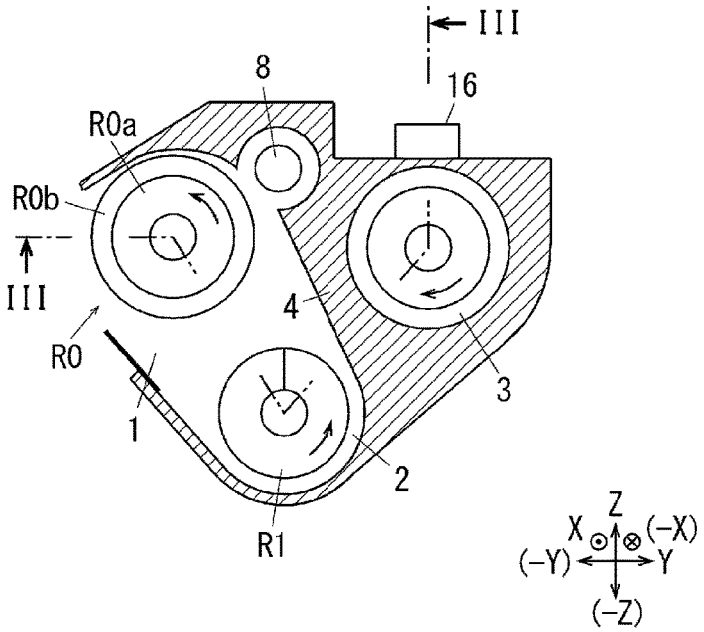
FIGS. 2A and 2B are diagrams each illustrating a developing device, FIG. 2A and FIG. 2B being respectively a cross-sectional view of a center portion of the developing device in a front-rear direction and a cross-sectional view of a rear end portion of the developing device in the front-rear direction.
Figure 2B:
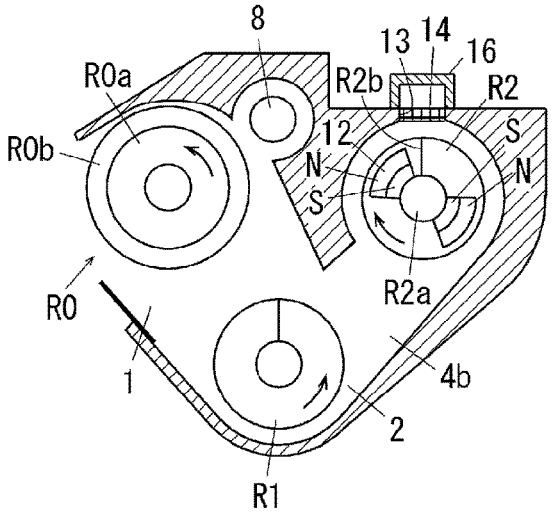
Figure 3:
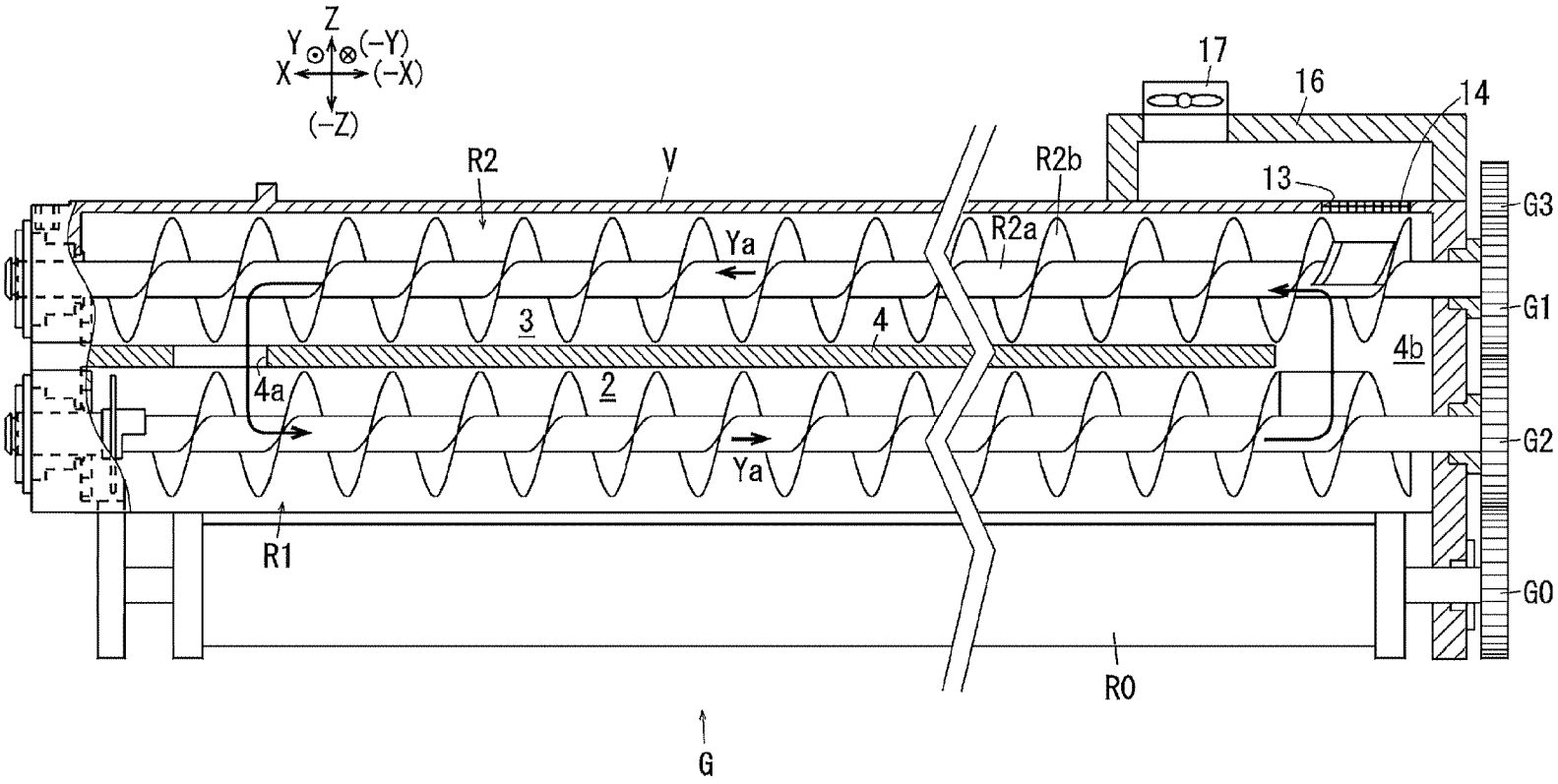
FIG. 3 is a sectional view taken along line III-III of FIG. 2A.

FIGS. 2A and 2B are diagrams each illustrating a developing device. FIG. 2A is a cross-sectional view of a center portion of the developing device in the front-rear direction, and FIG. 2B is a cross-sectional view of a rear end portion of the developing device in the front-rear direction. FIG. 3 is a sectional view taken along line III-III of FIG. 2A. In FIG. 1, the developing device G is disposed in such a manner as to face the photoconductor drum PR in a development region Q2. In FIG. 1 to FIG. 3, the developing device G includes a developer container V, which is an example of a container. A developing roller chamber 1, which is an example of a first container, is formed at the upper left portion in the developer container V. A supply chamber 2, which is an example of a second container, is formed at the lower right portion in the developing roller chamber 1. A stirring chamber 3, which is an example of a third container, is formed at the upper right portion in the supply chamber 2. The developing roller chamber 1 communicates with the supply chamber 2 in the front-rear direction.

A partition wall 4 is formed between the supply chamber 2 and the stirring chamber 3. As an example of inflow regions, communication ports 4*a* and 4*b* that enable communication between the supply chamber 2 and the stirring chamber 3 are respectively formed in a front end portion and a rear end portion of the partition wall 4. In FIG. 1 to FIG. 2B, in the developing roller chamber 1, a developing roller R0 is supported at a position facing the photoconductor drum PR. Note that, in the present exemplary embodiment, a rear end portion of the developing roller R0 in the axial direction of the developing roller R0 is located in the communication port 4*b*, which is an example of a pick-up region. A supply auger R1, which is an example of a second transport member, is disposed in the supply chamber 2. A stirring auger R2, which is an example of a first transport member, is disposed in the stirring chamber 3.

Note that the developing roller R0 is a commonly known member and includes a magnet roller R0*a*, which is an example of a magnet member, and a developing sleeve R0*b*, which is an example of a rotary member, the developing sleeve R0*b* covering the outer surface of the magnet roller R0*a*. Accordingly, a developer in the developer container V circulates in the direction of arrow Ya while being stirred by the augers R1 and R2. Thus, in the front communication port 4*a*, the developer enters the supply chamber 2, which is located on the lower side, from the stirring chamber 3, which is located on the upper side. In the rear communication port 4*b*, which is an example of the pick-up region, the developer is picked up (drawn up) from the supply chamber 2, which is located on the lower side, into the stirring chamber 3, which is located on the upper side. The augers R1 and R2 form a circulation transport member R1+R2, which is an example of a transport member that stirs and transports the developer while causing the developer to circulate.

In FIGS. 2A and 2B, a trimmer 8, which is an example of a layer-thickness control member, is supported in an upper portion of the developer container V. The trimmer 8 is disposed in such a manner as to face the developing roller R0. The trimmer 8 controls the layer thickness of the developer on a surface of the developing roller R0. In FIG. 3, a gear G1 is mounted on a rear end portion of the shaft of the auger R2, and a gear G2 is mounted on a rear end portion of the shaft of the augers R1. Note that a gear G0 is mounted on a rear end portion of the developing roller R0. When a developing operation is performed, the gears G0, G1, and G2 and an intermediate gear (not illustrated) are driven, and the developing roller R0 and the augers R1 and R2 rotate.

In FIG. 2A to FIG. 3, magnets 12, each of which is an example of a conveying member, are supported at positions on a rotary shaft R2*a* of the stirring auger R2, the positions facing the communication port 4*b*. The magnets 12 are each formed of a magnet. Accordingly, the magnets 12 are configured to be capable of holding a magnetic developer by using magnetic force thereof. As illustrated in FIG. 2B, the plural magnets 12 according to the present exemplary embodiment are arranged in the circumferential direction of the rotary shaft R2*a*. Note that the plural magnets 12 are supported at the same position in the axial direction of the rotary shaft R2*a*. In FIG. 3, the magnets 12 according to the present exemplary embodiment are supported on the rotary shaft R2*a* of the stirring auger R2 and arranged in a helical manner along a helical blade R2*b*.

Figure 4:
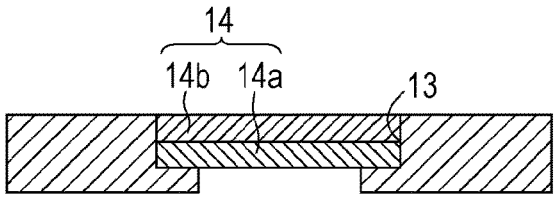
FIG. 4 is a diagram illustrating an exhaust port and a filter member according to the exemplary embodiment.

FIG. 4 is a diagram illustrating an exhaust port and a filter member according to the present exemplary embodiment. In FIG. 3, an exhaust port 13 is formed in the top surface of the stirring chamber 3 so as to be located at a position above the communication port 4*b*. A filter 14, which is an example of a filter member, is disposed in the exhaust port 13. Note that, in the present exemplary embodiment, the magnetic force of each of the magnets 12 is set in such a manner as to enable the developer held by the magnets 12 to slide on the inner surface of the filter 14. In addition, as an example, the filter 14 according to the present exemplary embodiment includes an inner layer 14*a* that is disposed on the inner side of the developer container V and an outer layer 14*b* that is disposed on the outer side of the developer container V. The inner layer 14*a* is formed of a fluorocarbon resin, which is an example of a wear-resistant material. In the present exemplary embodiment, polytetrafluoroethylene (PTFE), which is an example of a fluorocarbon resin, may be used as the material of the inner layer 14*a*. Although the inner layer 14*a* may be formed of a porous film in order to ensure high breathability of the inner layer 14*a*, the present invention is not limited to this, and for example, the inner layer 14*a* may be in the form of a mesh finer than the particle diameter of the developer. The outer layer 14*b* may be made of a material having breathability and a property of collecting the developer, and for example, a piece of nonwoven fabric, a piece of woven fabric, a resin net, and a foamed resin material may be used. In addition, although the thickness of the filter 14 may be suitably changed in accordance with a material that is used, it is necessary to set the thickness of the filter 14 in such a manner that the filter 14 has such breathability that the filter 14 is capable of releasing internal pressure, and the thickness of the filter 14 may be, for example, about 0.1 mm.

In FIG. 2A to FIG. 3, a duct 16, which is an example of an exhaust path, is supported at a position above the exhaust port 13. The duct 16 extends frontward along the top surface of the developer container V. A sirocco fan 17, which is an example of an exhaust member, is disposed at a front end portion of the duct 16. The sirocco fan 17 exhausts air inside the duct 16 to the outside of the developer container V.

Figure 5:
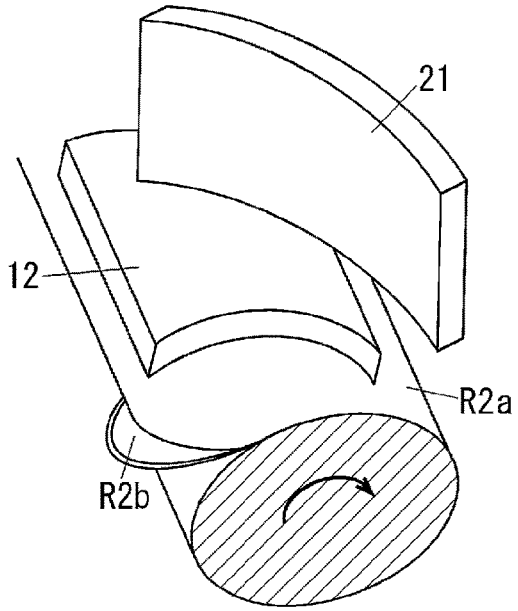
FIG. 5 is a diagram illustrating a scraping member according to the exemplary embodiment.

FIG. 5 is a diagram illustrating a scraping member according to the present exemplary embodiment. In FIGS. 2A and 2B and FIG. 5, a scraping plate 21, which is an example of a scraping member, is disposed on the top surface of the stirring chamber 3. The scraping plate 21 is disposed in such a manner that the lower end thereof is positioned close to the outer end of the helical blade R2*b* of the stirring auger R2. The scraping plate 21 is disposed so as to have a partial arc shape extending in the direction of rotation of the stirring auger R2 while surrounding the stirring auger R2 from an upper end portion to a downstream portion of the stirring auger R2 in the direction of gravity. The stirring auger R2 is obliquely disposed with respect to the axial direction of the stirring auger R2 in such a manner that the lower end thereof on the downstream side in a direction in which the developer is transported (the front side) is inclined toward the downstream side in the direction of rotation of the stirring auger R2.

(Operation in Exemplary Embodiment)

In the copying machine U according to the present exemplary embodiment, which has the above-described configuration, along with rotation of the developing roller R0, the trimmer 8 adjusts the thickness of the developer to a predetermined thickness, and the developer is used in a development region Q2 for a developing operation. The developer held on the surface of the developing roller R0 after a developing operation has been performed is caused to return to the developer container V along with rotation of the developing roller R0. In this case, the air between particles of the developer deposited on the surface of the developing roller R0 is sent into the developer container V along with rotation of the developing roller R0. Here, since the developer whose layer thickness has been controlled is present in a region in which the trimmer 8 and the developing roller R0 face each other, the air in the developer container V is unlikely to escape. Thus, the internal pressure of the developer container V is likely to increase along with rotation of the developing roller R0. If the internal pressure increases, the developer may sometimes be jetted out from an end of the developing roller R0 in the axial direction of the developing roller R0 or ends of the augers R1 and R2, and there is a possibility that the interior of the copying machine U and an image to be printed will be contaminated.

Figure 6:
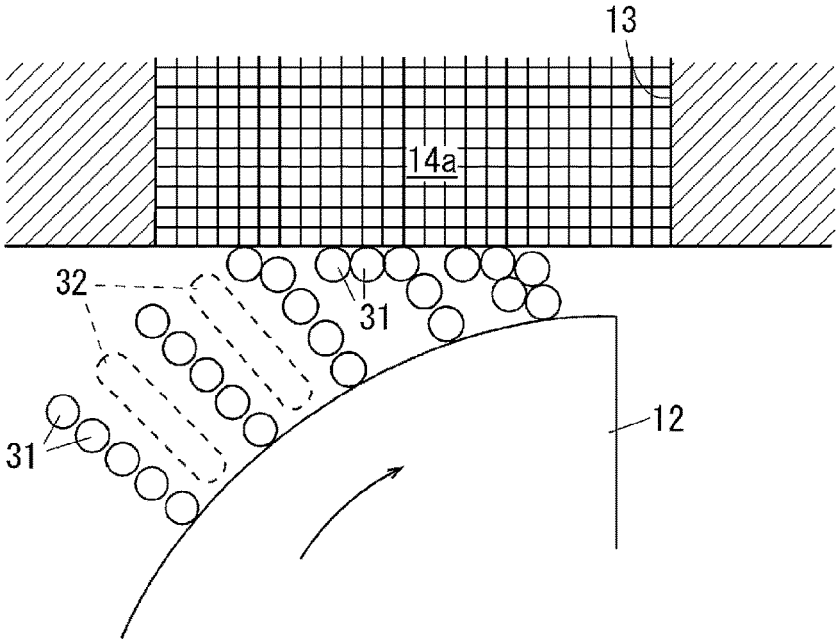
FIG. 6 is a diagram illustrating a cleaning operation performed by a filter according to the exemplary embodiment.

FIG. 6 is a diagram illustrating a cleaning operation performed by a filter according to the present exemplary embodiment. In the present exemplary embodiment, the magnets 12 are supported on the stirring auger R2. Consequently, the developer in the developer container V is attracted to the magnets 12. As illustrated in FIG. 6, a developer 31 that has been attracted to the magnets 12 is caused to rotate along with rotation of the stirring auger R2.

In this case, the developer 31 is caused to rotate in a state of forming a magnetic brush along lines of magnetic force of the magnets 12. Thus, the air in gaps 32 between bristles of the magnetic brush formed of the developer 31 is sent, along with rotation of the stirring auger R2, toward the exhaust port 13 located on the downstream side in the direction of rotation of the stirring auger R2. Accordingly, the air in the developer container V is exhausted through the exhaust port 13 along with rotation of the stirring auger R2. Therefore, the probability that the internal pressure of the developer container V will increase is lower than that in the case where the magnets 12 are not provided.

Note that, in the developing device G according to the present exemplary embodiment, the air is transported by the developer 31 held by the magnets 12, and in addition, the air is exhausted by the sirocco fan 17. Thus, the probability that the internal pressure of the developing device G will increase is lower than that in the case where the sirocco fan 17 is not provided. Here, as the rotational speed of the developing roller R0 becomes high, the air is more likely to be sent into the developer container V by the developing roller R0, and the internal pressure is likely to increase. Thus, in the case where the copying machine U includes the developing roller R0 whose rotational speed is low, the internal pressure may be kept within an acceptable range without providing the sirocco fan 17. In other words, a configuration in which the sirocco fan 17 is not provided may be employed. In addition, in the case where the image forming speed varies with, for example, types of sheet, such as a normal sheet and a thick sheet, or printing modes, such as monochrome printing and color printing, and where the rotational speed of the developing roller R0 is changed in accordance with the image forming speed, control may be performed in such a manner that the sirocco fan 17 is not driven when the rotational speed is low and is driven when the rotational speed is high.

In the present exemplary embodiment, the filter 14 is disposed in the exhaust port 13. Therefore, a probability that the developer will leak to the outside of the developing device G together with the exhausted air is lower than that in the case where the filter 14 is not provided. In addition, in the developing device G according to the present exemplary embodiment, the developer 31 held by the magnets 12 is brought into contact with the inner surface of the filter 14. Accordingly, the inner surface of the filter 14 is periodically rubbed by the developer 31. Thus, even if the developer floating in the air to be exhausted is deposited on the surface of the filter 14, the developer will be removed by being rubbed periodically, and the surface will be cleaned. Therefore, a probability that the filter 14 will become clogged is reduced, and an increase in the internal pressure of the developing device G is suppressed for a long period of time, whereas if the magnets 12 are not provided, the probability that the filter 14 will become clogged will not be reduced, and an increase in the internal pressure of the developing device G will not be suppressed for a long period of time. Consequently, the frequency of replacement of the filter 14 is lower than that in the case where such a cleaning configuration is not employed.

In particular, the inner layer 14*a* of the filter 14 according to the present exemplary embodiment is made of a fluorocarbon resin having favorable releasability and high wear resistance. Thus, even when the developer is deposited on the filter 14, the developer may be easily removed as a result of the filter 14 being rubbed by the developer 31 held by the magnets 12. In addition, the filter 14 is less likely to wear even when the developer 31 rubs against the filter 14, and the service life of the filter 14 is longer compared with the case where a fluorocarbon resin is not used. In the developing device G according to the present exemplary embodiment, the plural magnets 12 are supported in the direction of rotation of the stirring auger R2. Thus, the frequency with which the developer 31 rubs against the filter 14 is higher than that in the case where only one magnet 12 is provided. Therefore, the probability that the filter 14 will become clogged is further reduced.

In addition, in the developing device G according to the present exemplary embodiment, the magnets 12 are disposed in such a manner as to face the communication port 4*b*. In the communication port 4*b* located on the rear side of the developer container V according to the present exemplary embodiment, the developer is drawn from the supply chamber 2, which is located on the lower side, into the stirring chamber 3, which is located on the upper side. Thus, the magnets 12, which are supported on the stirring auger R2 located on the upper side, attract the developer in the supply chamber 2, which is located on the lower side, and move the developer upward. Therefore, the magnets 12 according to the present exemplary embodiment facilitate drawing of the developer in the communication port 4*b*. In the case where drawing of the developer is not facilitated, the developer accumulates in a downstream end portion (rear end portion) of the supply chamber 2. Consequently, the developer is likely to be supplied to an end of the developing roller R0 that is supported in the developing roller chamber 1, which is in communication with the supply chamber 2. As a result, the density of the developer in the rear end portion of the developing roller R0 in the axial direction of the developing roller R0 is likely to become high, and there is a possibility of unevenness in the density occurring in an image that is printed. In contrast, in the present exemplary embodiment, the magnets 12 facilitate drawing of the developer, so that the probability of unevenness in the density occurring in an image that is printed is reduced. Note that the developer that is drawn by being attracted to the magnets 12 is separated from the magnets 12 by the scraping plate 21 and contained in the stirring chamber 3.

Figure 7A:
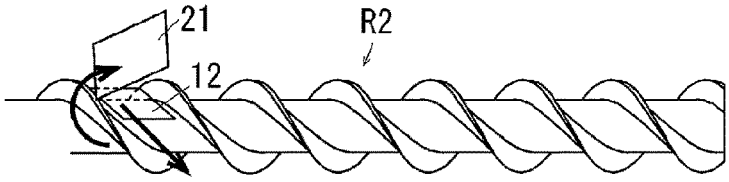
FIGS. 7A and 7B are diagrams each illustrating a relationship between magnets and a stirring auger, FIG. 7A and FIG. 7B respectively being a diagram illustrating a configuration according to the exemplary embodiment and a diagram illustrating a configuration according to a modification.
Figure 7B:
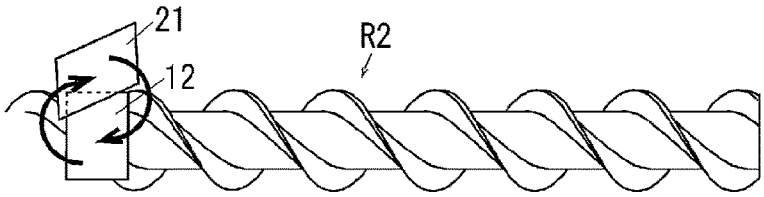

FIGS. 7A and 7B are diagrams each illustrating a relationship between magnets and a stirring auger. FIG. 7A is a diagram illustrating the configuration according to the present exemplary embodiment, and FIG. 7B illustrates a diagram illustrating a configuration according to a modification. In the developing device G according to the exemplary embodiment, the magnets 12 are arranged in a helical manner along the helical blade R2*b*. Consequently, as illustrated in FIG. 7A, the developer that is separated from the magnets 12 by the scraping plate 21 is transported to a position downstream in the transport direction of the stirring auger R2 along an inclined surface of the helical blade R2*b*. As illustrated in FIG. 7B, in the case where the magnets 12 are arranged not in a helical manner (not in a direction inclined with respect to the direction of gravity), but in the direction of gravity, there is a possibility that the developer separated from the magnets 12 by the scraping plate 21 will move downward in the direction of gravity and will be attracted to the magnets 12 again. Thus, the developer in the communication port 4*b* is unlikely to be transported to the downstream side in the stirring chamber 3, and the developer may sometimes accumulate in the communication port 4*b*. In the developing device G according to the exemplary embodiment that includes the magnets 12 arranged in a helical manner, accumulation of the developer may be suppressed.

Figure 8A:
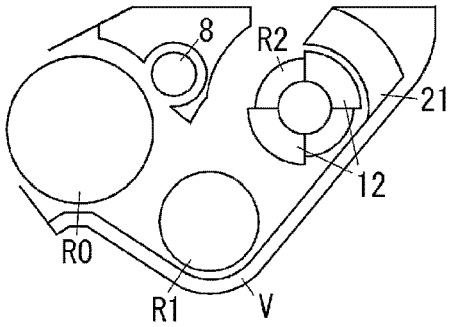
FIGS. 8A to 8D are diagrams each illustrating a relationship between the position of the scraping member and a developer, FIG. 8A, FIG. 8B, FIG. 8C, and FIG. 8D being respectively a cross-sectional view illustrating the exemplary embodiment, a perspective view illustrating the scraping member and the stirring auger according to the exemplary embodiment, a cross-sectional view illustrating another example, and a perspective view illustrating the other example.
Figure 8B:
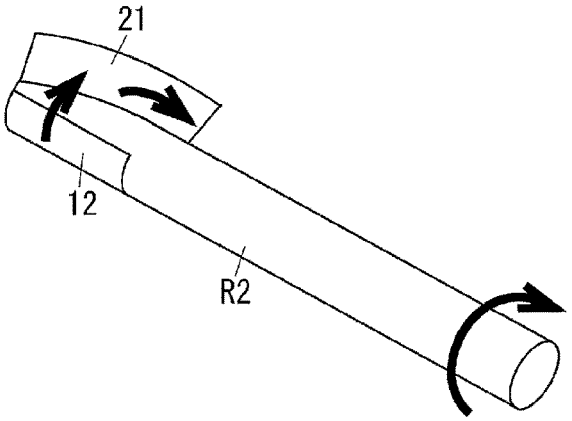
Figure 8C:
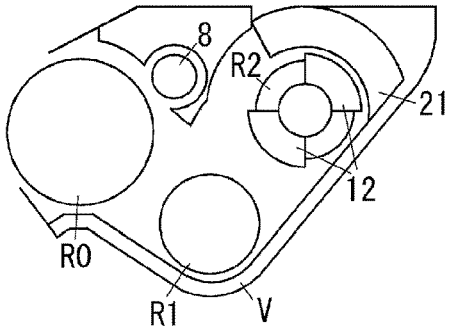
Figure 8D:
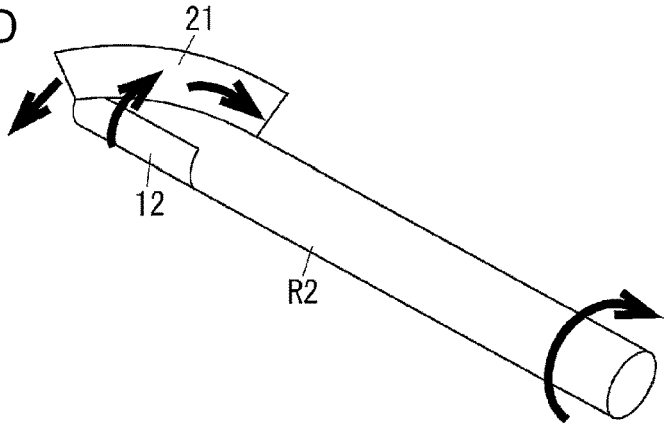

FIGS. 8A to 8D are diagrams each illustrating a relationship between the position of the scraping member and a developer. FIG. 8A is a cross-sectional view illustrating the present exemplary embodiment. FIG. 8B is a perspective view illustrating the scraping member and the stirring auger according to the present exemplary embodiment. FIG. 8C is a cross-sectional view illustrating another example. FIG. 8D is a perspective view illustrating the other example. As illustrated in FIG. 8C and FIG. 8D, in the case where, in the direction of rotation of the stirring auger R2, the upstream end of the scraping plate 21 is positioned further upstream than the upper end of the stirring auger R2 in the direction of gravity, when the developer separated from the magnets 12 falls due to gravity, the developer may sometimes move in a direction opposite to the direction of rotation of the stirring auger R2. In other words, the developer may sometimes flow backward. In this case, the developer in the communication port 4*b* will not be transported to a downstream side in the stirring chamber 3, and as a result, the developer will accumulate in the communication port 4*b*. In contrast, as illustrated in FIG. 8A and FIG. 8B, in the developing device G according to the exemplary embodiment, the upstream end of the scraping plate 21 is positioned further downstream than the upper end of the stirring auger R2. Consequently, when the developer separated from the magnets 12 falls due to gravity, the developer moves in the direction of rotation of the stirring auger R2. Therefore, the developer is likely to be transported to a position on the downstream side along the helical blade R2*b* of the stirring auger R2, so that the developer is less likely to accumulate in the communication port 4*b*. As a result of the scraping plate 21 separating the developer from the magnets 12, the air contained in the magnetic brush formed of the developer is released, so that the air is effectively guided to the exhaust port 13, which is located in the vicinity of the scraping plate 21.

(Descriptions of Other Examples)

Figure 9:
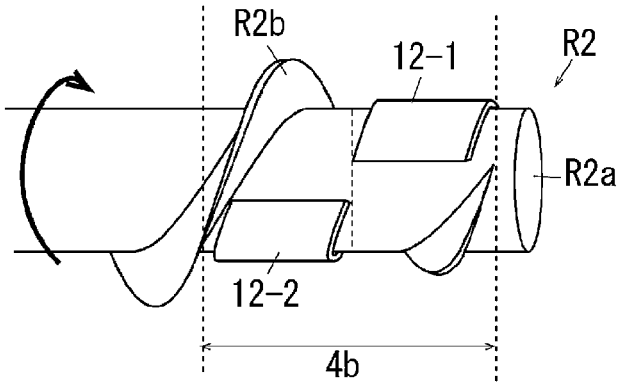
FIG. 9 is a diagram illustrating an arrangement of magnets according to a modification of the exemplary embodiment.

FIG. 9 is a diagram illustrating an arrangement of magnets according to a modification of the present exemplary embodiment. In the present exemplary embodiment, although a configuration has been described as an example in which the magnets 12 are arranged at the same position in the axial direction of the stirring auger R2, the present invention is not limited to this configuration. As illustrated in FIG. 9, the magnets 12 may be arranged in such a manner as to be displaced from each other in the axial direction of the stirring auger R2. As illustrated in FIG. 9, a configuration may be employed in which the developer is transported in a transport direction of the developer by using the plural magnets 12 in such a manner that the developer separated from a magnet 12-1 that is disposed on the upstream side in a direction in which the stirring auger R2 transports the developer is attracted to a magnet 12-2 that is disposed on the downstream side.

Figure 10A:
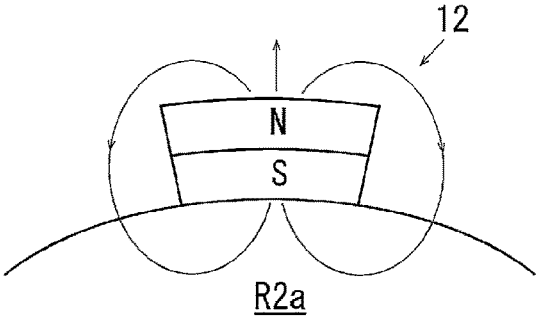
FIGS. 10A to 10C are diagrams illustrating arrangements of magnetic poles of a magnet, FIG. 10A, FIG. 10B, and FIG. 10C being respectively a diagram illustrating the configuration according to the exemplary embodiment, a diagram illustrating a modification of the exemplary embodiment, and a diagram illustrating another modification of the exemplary embodiment.
Figure 10B:
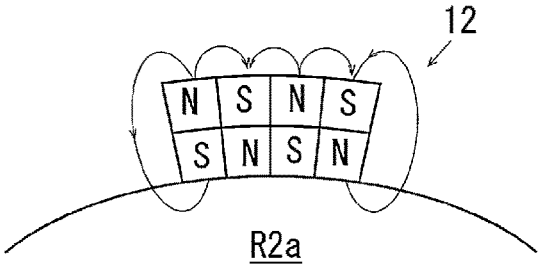
Figure 10C:
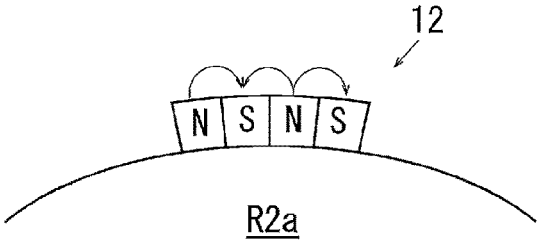

FIGS. 10A to 10C are diagrams illustrating arrangements of magnetic poles of a magnet. FIG. 10A is a diagram illustrating the configuration according to the present exemplary embodiment. FIG. 10B is a diagram illustrating a modification of the present exemplary embodiment. FIG. 10C is a diagram illustrating another modification of the present exemplary embodiment. As illustrated in FIG. 10A, the S pole of each of the magnets 12 according to the present exemplary embodiment is arranged on a first side on which the magnet 12 is supported on the rotary shaft R2*a*, and the N pole of the magnet 12 is arranged on a second side opposite to the first side (the side opposite to the first side in a radial direction). The arrangement of the magnetic poles may be changed to, for example, the arrangement illustrated in FIG. 10B or the arrangement illustrated in FIG. 10C in accordance with the amount of the developer that is desired to be drawn, the magnetic force that is required, the force with which the developer rubs against the filter 14, and the like. As illustrated in FIG. 10B, the magnetic poles may be alternately arranged in the radial direction of the stirring auger R2 and in the circumferential direction. Alternatively, as illustrated in FIG. 10C, the magnetic poles may be alternately arranged only in the circumferential direction. Therefore, by changing the arrangement of the magnetic poles, that is, by changing the shape of a magnetic brush formed of the developer along lines of magnetic force, the amount of the air sent toward the exhaust port 13 and the force with which the developer rubs against the filter 14 may be changed.

Figure 11A:
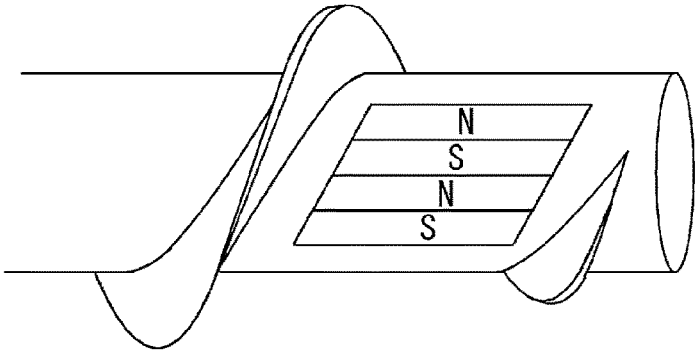
FIGS. 11A to 11C are diagrams illustrating arrangements of magnetic poles of a magnet, FIG. 11A, FIG. 11B, and FIG. 11C being respectively a diagram illustrating a case where the magnetic poles are alternately arranged in a circumferential direction, a diagram illustrating a case where the magnetic poles are alternately arranged in an axial direction, and a diagram illustrating a case where the magnetic poles are arranged in such a manner as to be inclined with respect to the axial direction and in the circumferential direction.
Figure 11B:
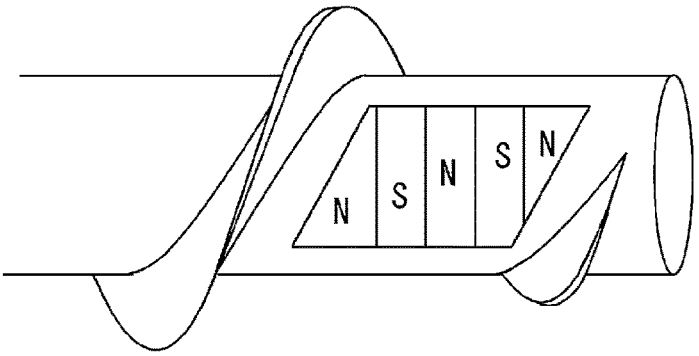
Figure 11C:
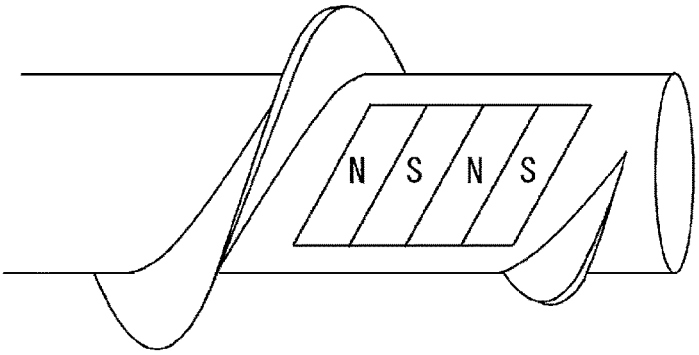

FIGS. 11A to 11C are diagrams illustrating arrangements of magnetic poles of a magnet. FIG. 11A is a diagram illustrating a case where the magnetic poles are alternately arranged in a circumferential direction. FIG. 11B is a diagram illustrating a case where the magnetic poles are alternately arranged in an axial direction. FIG. 11C is a diagram illustrating a case where the magnetic poles are arranged in such a manner as to be inclined with respect to the axial direction and the circumferential direction. In the configurations illustrated in FIG. 10B and FIG. 10C, the magnetic poles may be arranged in any manner, and for example, one of the arrangements illustrated in FIG. 11A to FIG. 11C may be employed. In the case where the arrangement illustrated in FIG. 11A is employed, a magnetic force acts between the magnetic pole on the upstream side and the magnetic pole on the downstream side in the direction of rotation of the stirring auger R2. In other words, a magnetic force is generated in the direction of rotation of the stirring auger R2. Therefore, it is unlikely that the developer will fall due to, for example, a centrifugal force generated when the stirring auger R2 rotates, and the air is likely to be stably conveyed. In addition, the force with which the developer rubs against the filter 14 increases. In contrast, in the case where the arrangement illustrated in FIG. 11B is employed, a magnetic force is generated in the axial direction of the stirring auger R2. Therefore, when the developer is brought into contact with the scraping plate 21, the developer is likely to be smoothly separated from the magnets 12. In the case where the arrangement illustrated in FIG. 11C is employed, characteristics are obtained, the characteristics being a cross between the characteristics obtained by the arrangement illustrated in FIG. 11A and the characteristics obtained by the arrangement illustrated in FIG. 11B. The developer is more likely to be separated from the magnets 12 compared with the case illustrated in FIG. 11A, and the force with which the developer rubs against the filter 14 is larger than that in the case illustrated in FIG. 11B. Therefore, the direction in which the magnetic poles are arranged may be changed in accordance with the detachability of the developer that is required and the force with which the developer rubs against the filter 14.

(Modifications)

Although the exemplary embodiments of the present invention have been described in detail above, the present invention is not limited to the above-described exemplary embodiments, and various changes may be made within the scope of the present invention as described in the claims. Exemplary modifications (H01 to H06) of the present invention will be described below. (H01) In the above-described exemplary embodiments, although the copying machine U has been described as an example of an image forming apparatus, the image forming apparatus is not limited to the copying machine U, and the present invention may be applied to a printer, a facsimile machine, a multifunction machine having plural functions of such a printer and such a facsimile machine, and the like. In addition, the image forming apparatus is not limited to an image forming apparatus for monochromatic development and may be an image forming apparatus that forms a polychromatic image, or specifically a color image.

(H02) In the above-described exemplary embodiments, although a configuration has been described as an example in which the positional relationship between the supply auger R1 and the stirring auger R2 is that the stirring auger R2 is disposed diagonally above the supply auger R1, the present invention is not limited to this configuration. For example, the present invention may be applied to a developing device in which a supply auger and a stirring auger are arranged side by side horizontally or vertically or may be applied to a developing device in which a stirring auger is disposed diagonally below a supply auger. (H03) In the above-described exemplary embodiments, the exhaust port 13 is not limited to being positioned above the communication port 4*b*. The exhaust port 13 may be formed at an arbitrary position as long as the air is exhausted through the exhaust port 13 in such a manner as to decrease the internal pressure. For example, the exhaust port 13 may be formed in a center portion or a front end portion of the stirring chamber 3 in the front-rear direction. Alternatively, the exhaust port 13 may be formed in the supply chamber 2 or in the developing roller chamber 1. Accordingly, although it is desirable that the magnets 12 be also used for drawing of the developer in the communication port 4*b*, the present invention is not limited to this configuration. The magnets 12 may be arranged in accordance with the position of the exhaust port 13.

(H04) In the above-described exemplary embodiments, although a configuration has been described as an example in which the filter 14 has a two-layer structure, the present invention is not limited to this configuration. Any filter may be used as long as the filter is capable of filtering the developer while enabling the air to pass therethrough, and a filter having three or more layers or a filter having a single-layer structure may be used. Note that a configuration in which the filter 14 is not provided may be employed in the case where the length of the duct 16 is long such that the developer is unlikely to leak or may be employed depending on the acceptable amount of leakage of the developer. (H05) The shape, size, number, and the like of the scraping plate 21 are not limited to those described as examples in the exemplary embodiments and may be arbitrarily changed. Therefore, the shape of the scraping plate 21 is not limited to a plate-like shape and may be a block shape or the like, and the length of the scraping plate 21 in the axial direction and the shape of the scraping plate 21 in the circumferential direction may also be changed. Alternatively, a configuration in which two or more scraping plates 21 are provided may be employed.

(H06) In the above-described exemplary embodiments, although a configuration has been described as an example in which the magnets 12 hold the developer and convey the air, the present invention is not limited to this configuration. For example, an electromagnet may be used instead of a magnet. Alternatively, a brush, a plate, or the like to which a voltage has been applied in such a manner as to electrostatically attract the developer may be used.

The foregoing description of the present exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A developing device comprising:

a developer carrier that rotates while holding a developer;

a developer container that supports the developer carrier and contains the developer;

a transport member that is supported in the developer container, that has a helical blade disposed along an axial direction of the transport member and that transports the developer by rotating;

a conveying member that is disposed on the transport member and along the helical blade and that conveys air in the developer container toward an exhaust port, which enables the air in the developer container to be exhausted outside, along with rotation of the transport member;

and a filter member that is disposed in the exhaust port and that enables the air to pass through the filter member while not enabling the developer to pass through the filter member.

2. A developing device comprising:

a developer carrier that rotates while holding a developer;

a developer container that supports the developer carrier and contains the developer;

a transport member that is supported in the developer container and that transports the developer by rotating;

a conveying member that is formed of a magnet attracting the developer, that is disposed at a position on the transport member, the position facing an exhaust port, the developer being attracted to the conveying member to form a brush which enables air in the developer container to be exhausted outside, and that rotates with the transport member while holding the developer, wherein the developer is a magnetic developer;

and a filter member that is disposed in the exhaust port and that enables the air to pass through the filter member while not enabling the developer to pass through the filter member.

3. The developing device according to claim 1, wherein the filter member has a surface layer that is positioned at a surface on an inner side of the developer container and that is made of a wear-resistant material resistant to wear due to the developer sliding on the surface layer.

4. The developing device according to claim 2, wherein the filter member has a surface layer that is positioned at a surface on an inner side of the developer container and that is made of a wear-resistant material resistant to wear due to the developer sliding on the surface layer.

5. The developing device according to claim 1, further comprising:

an exhaust member that is connected to the exhaust port and that exhausts the air in the developer container toward outside.

6. The developing device according to claim 1, further comprising:

a plurality of the conveying members that are arranged in a circumferential direction of rotation of the transport member.

7. The developing device according to claim 6, wherein the plurality of conveying members are arranged at the same position in a direction in which a rotary shaft of the transport member extends.

8. The developing device according to claim 6, wherein the plurality of conveying members are arranged in such a manner as to be displaced from each other in a direction in which a rotary shaft of the transport member extends.

9. The developing device according to claim 1, wherein the conveying member is formed of a magnet that attracts a magnetic developer.

10. The developing device according to claim 9, wherein the conveying member has a first magnetic pole that is positioned at a surface supported on the transport member and a second magnetic pole that is positioned at a surface opposite to the surface supported on the transport member, the second magnetic pole having a polarity opposite to a polarity of the first magnetic pole.

11. The developing device according to claim 9, wherein the conveying member is formed of a magnet that has a first magnetic pole and a second magnetic pole arranged in a direction of rotation of the transport member, the second magnetic pole having a polarity opposite to a polarity of the first magnetic pole.

12. The developing device according to claim 9, wherein the conveying member is formed of a magnet that has a first magnetic pole and a second magnetic pole arranged in such a manner as to be inclined with respect to a direction in which a rotary shaft of the transport member extends, the second magnetic pole having a polarity opposite to a polarity of the first magnetic pole.

13. The developing device according to claim 1, wherein the transport member includes a first transport member that transports the developer in a predetermined first direction and a second transport member that is disposed below the first transport member and that transports the developer in a direction opposite to the first direction and wherein the conveying member is positioned in such a manner as to face a pick-up region, in which the developer transported by the second transport member is moved toward the first transport member above the second transport member, and is supported on the first transport member.

14. An image forming apparatus comprising:

an image carrier that holds an image on a surface of the image carrier;

developing device according to claim 1 that develops a latent image held on the surface of the image carrier into a visible image;

a transfer device that transfers the visible image onto a medium; and a fixing device that fixes the visible image, which has been transferred onto the medium, onto the medium.

* * * * *